US010755560B2

(12) United States Patent
Marecek et al.

(10) Patent No.: US 10,755,560 B2
(45) Date of Patent: Aug. 25, 2020

(54) REAL-TIME POLLUTION CONTROL AT A TRAFFIC JUNCTION

(71) Applicant: INTERNATIONAL BUSINESS MACHINES CORPORATION, Armonk, NY (US)

(72) Inventors: Jakub Marecek, Dublin (IE); Julien Monteil, Dublin (IE); Jonathan P. Epperlein, Phibsborough (IE)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/011,942

(22) Filed: Jun. 19, 2018

(65) Prior Publication Data

US 2019/0385447 A1 Dec. 19, 2019

(51) Int. Cl.
*G08G 1/01* (2006.01)

(52) U.S. Cl.
CPC ..... *G08G 1/0145* (2013.01)

(58) Field of Classification Search
CPC .. B60H 1/00771; B60H 1/008; B60H 3/0085; G01N 15/06; G01N 33/0004; G01N 33/0036; G01N 33/0062; G01N 33/0075; G06F 17/5009; G08G 1/07; H04L 43/045; Y02A 20/16
USPC ..... 340/917
See application file for complete search history.

(56) References Cited

U.S. PATENT DOCUMENTS 3,241,104 A * 3/1966 Du Vivier ..... G08G 1/082 340/911
4,370,718 A * 1/1983 Chasek ..... G08G 1/08 340/911
5,402,519 A * 3/1995 Inoue ..... G06N 3/0436 706/16
2004/0039517 A1* 2/2004 Biesinger ..... G08G 1/01 701/117
2004/0167861 A1* 8/2004 Hedley ..... G06Q 30/0283 705/400
2010/0153192 A1* 6/2010 Hamilton, II ..... G06Q 10/02 705/13
2011/0043378 A1* 2/2011 Bailey ..... G08G 1/07 340/917
2013/0099942 A1 4/2013 Mantalvanos
2014/0032175 A1* 1/2014 Agrawal ..... H04L 67/12 702/189
2016/0027299 A1 1/2016 Raamot
2017/0276658 A1* 9/2017 Zilio ..... G01N 33/0075
2017/0300818 A1* 10/2017 Sinitsyn ..... G06F 17/5009
(Continued)

FOREIGN PATENT DOCUMENTS

CN 10640898 A 2/2017

*Primary Examiner* — Stephen R Burgdorf
(74) *Attorney, Agent, or Firm* — Griffiths & Seaton PLLC

(57) ABSTRACT

A system and method for real-time pollution control at a traffic junction are presented. A pollution level may be determined at the traffic junction according to weather, traffic volume, traffic type, pollution measurements, topology, or a combination thereof. A traffic volume threshold may be determined for the traffic junction to maintain the pollution level below a pollution threshold. One or more parameters of the traffic junction may be set to maintain traffic volume below the traffic volume threshold.

17 Claims, 10 Drawing Sheets

(56) References Cited

U.S. PATENT DOCUMENTS

| | | | | |
|---|---|---|---|---|
| 2018/0211523 | A1* | 7/2018 | Ashida | G08G 1/0129 |
| 2019/0206238 | A1* | 7/2019 | Hofsaess | B60W 50/00 |

* cited by examiner

REAL-TIME POLLUTION CONTROL AT A TRAFFIC JUNCTION

BACKGROUND OF THE INVENTION

Field of the Invention

The present invention relates in general to computing systems, and more particularly to, various embodiments for controlling pollution at a traffic junction by a processor.

Description of the Related Art

In today's society, consumers, business persons, educators, and others use various computing network systems with increasing frequency in a variety of settings. Computer systems may be found in the workplace, at home, or at school. Computer systems may include data storage systems, or disk storage systems, to process and store data. In recent years, both software and hardware technologies have experienced amazing advancement. With the new technology, more and more functions are added, and greater convenience is provided for use with these computing systems such as, for example, in transportation industries.

SUMMARY OF THE INVENTION

Various embodiments for real-time pollution control at a traffic junction using one or more processors are provided. In one embodiment, by way of example only, a method for controlling pollution at a traffic junction, again by a processor, is provided. A pollution level may be determined at the traffic junction according to weather, traffic volume, traffic type, pollution measurements, topology, or a combination thereof. A traffic volume threshold may be determined for the traffic junction to maintain the pollution level below a pollution threshold. One or more parameters of the traffic junction may be set to maintain traffic volume below the traffic volume threshold.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
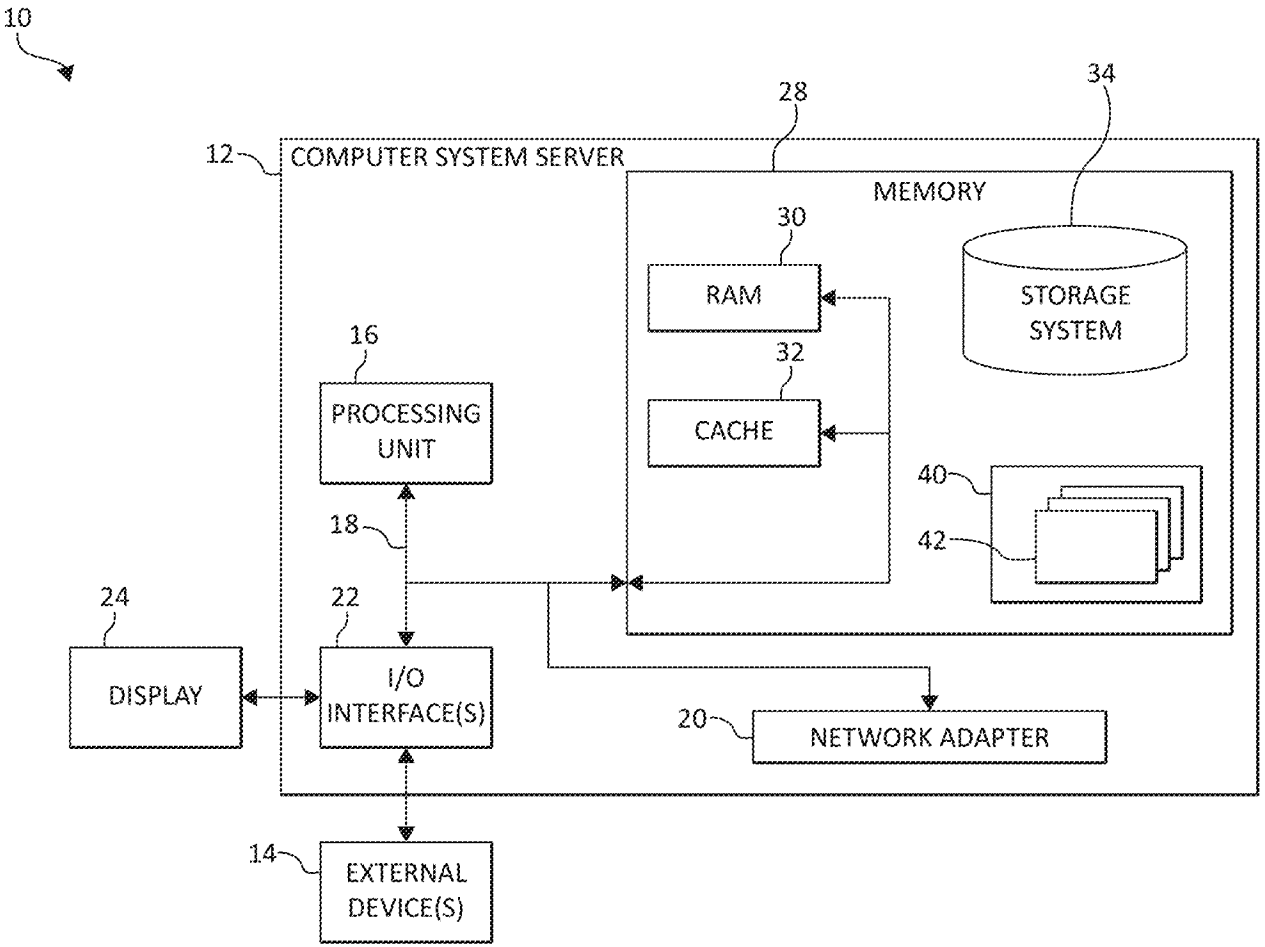
FIG. 1 is a block diagram depicting an exemplary computing node according to an embodiment of the present invention.

Throughout the world, traffic congestion can be a substantial negative externality on both individuals and community infrastructures. For example, the Centre for Economics and Business Research and INRIX estimates that the cost of traffic congestion in the UK, France, Germany, and the USA alone runs at $200 billion annually. The Intelligent Transportation Systems market is expected to grow to $63.66 Billion by 2022. A large city, for example, may have between 5,000 to 10,000 intersections (e.g., traffic junctions) that are controlled by a traffic control system (e.g., a stop light). Often these traffic control systems are utilized to reduce traffic congestion on the roadways. However, the amount of traffic flowing through each of these intersections may create large amounts of pollution, which is a major challenge for many communities and regions. In particular, abnormally high concentrations of pollutants may impact the overall health and well-being of drivers, passengers, or other persons at or near a polluted area.

Traditionally, the focus has been on the throughput of passengers' cars, using density-based or queue-based approaches. Few systems provide guarantees to maximize throughput while also taking into consideration attempts to reduce the amount of pollution caused by such traffic. Conventional traffic control systems are not customized for the specific traffic parameters of a particular traffic intersection and provide minimal to no consideration of an offset between multiple traffic intersections in congested conditions nor address the need to provide real-time pollution control at a traffic junction. For example, conventional traffic control systems do not account for an effect of queue spillback or consider how demand starvation at one traffic intersection can affect another traffic intersection. These conventional traffic control systems also fail to regulate the amount of traffic at the traffic junction so as to maintain pollution levels at or below a defined or "maximum" pollution level.

Thus, a need exists need for providing a solution to provide real-time pollution control at a traffic junction. In one aspect, a pollution level may be determined at the traffic junction according to weather, traffic volume, traffic type, pollution measurements, topology, or a combination thereof. A traffic volume threshold may be determined for the traffic junction to maintain the pollution level below a pollution threshold. One or more parameters of the traffic junction may be set to maintain traffic volume below the traffic volume threshold.

In an additional aspect, the present invention provides real-time control of pollution (e.g., air pollution and noise pollution). Pollution levels may be estimated from one or more sensor readings. Pedestrian flows may also be estimated from one or more sensor readings (e.g., infrared "IR" sensors) and/or global system for mobile communications ("GSM") systems. Traffic flows may be controlled according to an optimization operation to generate control directives that reduce and/or maintain the amount of pollution below a pollution threshold level. The present invention also provides regulation (pollution within limit, in a dispersion model) and stability controls and guarantees.

It should be noted that one or more computations or calculations may be performed using various mathematical operations or functions that may involve one or more mathematical operations (e.g., solving differential equations or partial differential equations analytically or computationally, using addition, subtraction, division, multiplication, standard deviations, means, averages, percentages, statistical modeling using statistical distributions, by finding minimums, maximums or similar thresholds for combined variables, etc.).

Also, as used herein, a computing system may include large scale computing called "cloud computing" in which resources may interact and/or be accessed via a communications system, such as a computer network. Resources may be software-rendered simulations and/or emulations of computing devices, storage devices, applications, and/or other computer-related devices and/or services run on one or more computing devices, such as a server. For example, a plurality of servers may communicate and/or share information that may expand and/or contract across servers depending on an amount of processing power, storage space, and/or other computing resources needed to accomplish requested tasks. The word "cloud" alludes to the cloud-shaped appearance of a diagram of interconnectivity between computing devices, computer networks, and/or other computer related devices that interact in such an arrangement.

Other examples of various aspects of the illustrated embodiments, and corresponding benefits, will be described further herein.

It is understood in advance that although this disclosure includes a detailed description on cloud computing, implementation of the teachings recited herein are not limited to a cloud computing environment and/or computing systems associated with one or more vehicles. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 1, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, system memory 28 may include at least one program product having a set (e.g., at least one) of program modules that are configured to carry out the functions of embodiments of the invention.

Program/utility 40, having a set (at least one) of program modules 42, may be stored in system memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 2:
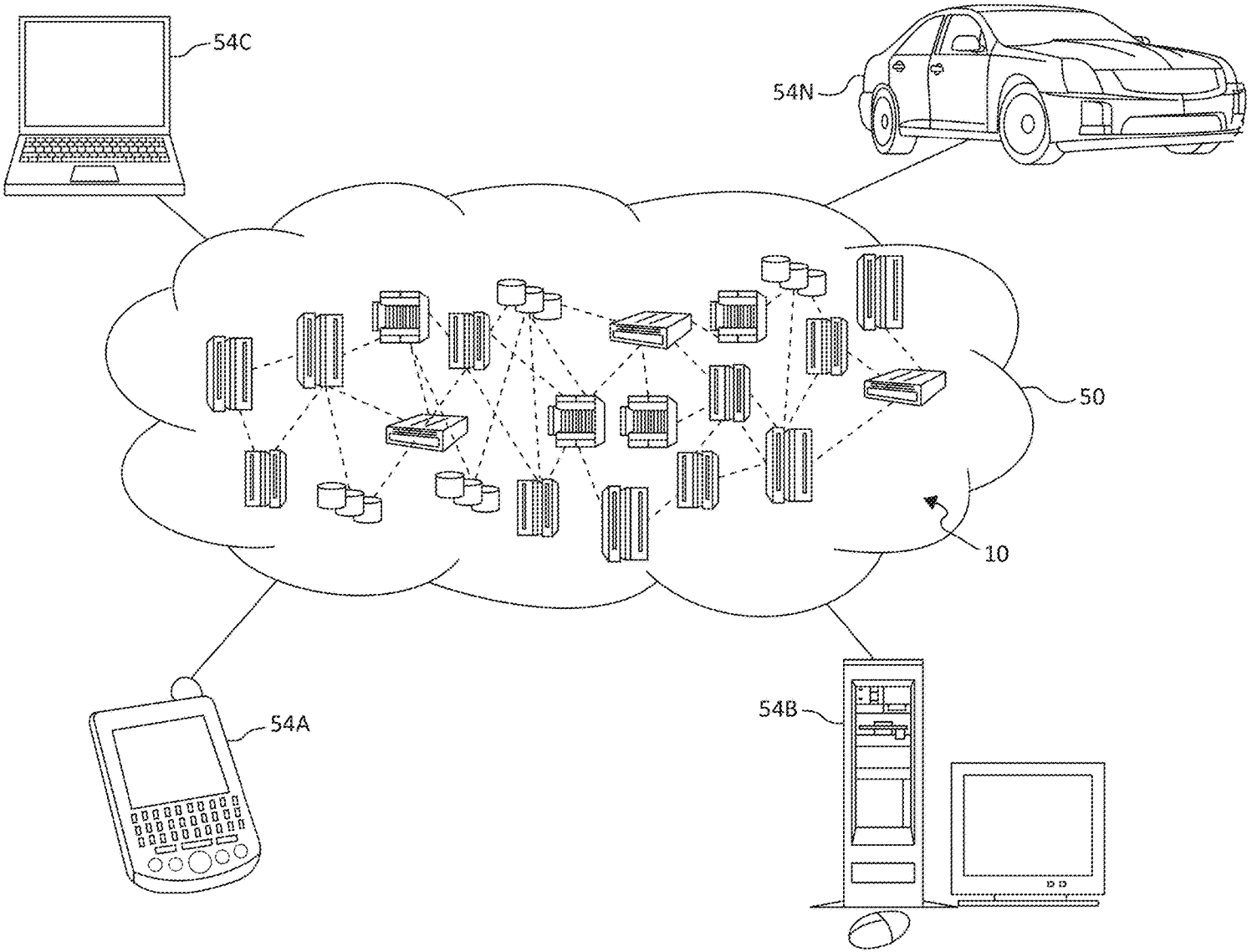
FIG. 2 is an additional block diagram depicting an exemplary cloud computing environment according to an embodiment of the present invention.

Referring now to FIG. 2, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 2 are intended to be illustrative only and that computing nodes 10 and cloud computing environment 50 can communicate with any type of computerized device over any type of network and/or network addressable connection (e.g., using a web browser).

Figure 3:
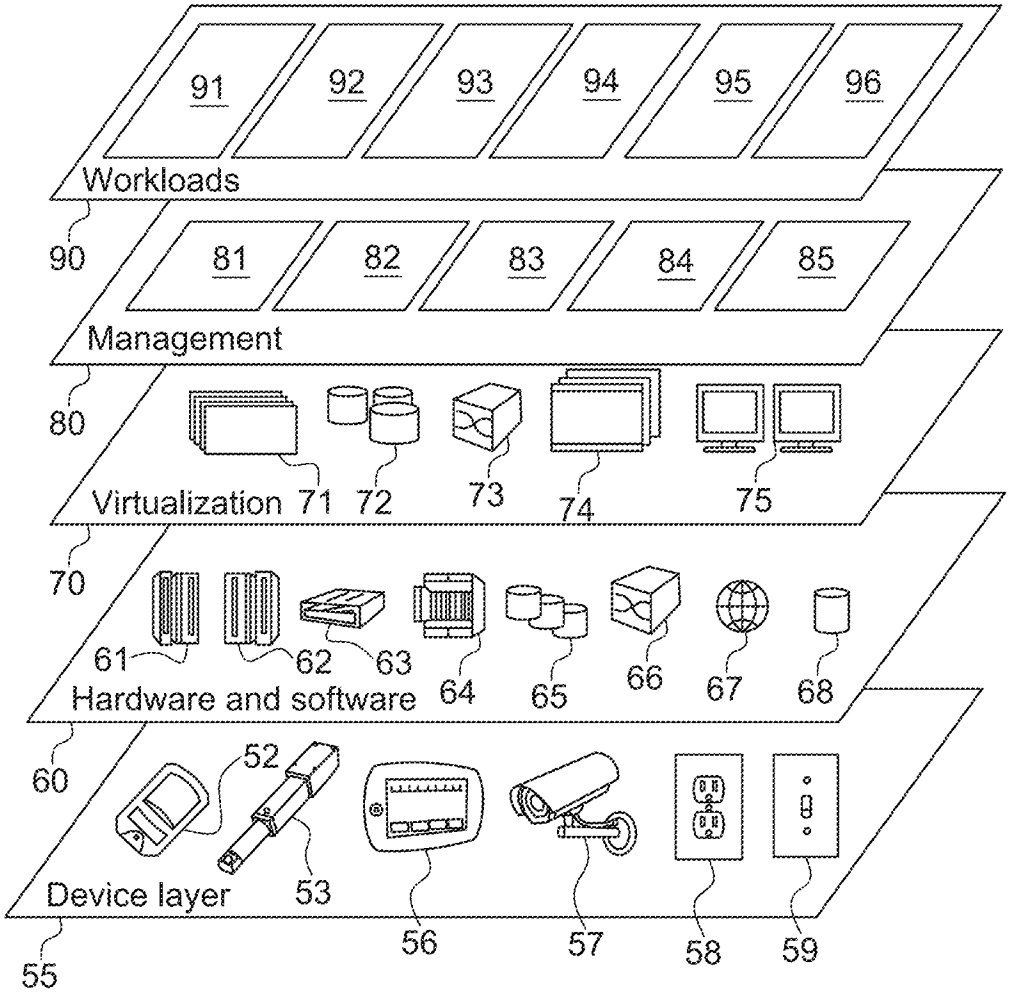
FIG. 3 is an additional block diagram depicting abstraction model layers according to an embodiment of the present invention.

Referring now to FIG. 3, a set of functional abstraction layers provided by cloud computing environment 50 (FIG. 2) is shown. It should be understood in advance that the components, layers, and functions shown in FIG. 3 are intended to be illustrative only and embodiments of the invention are not limited thereto. As depicted, the following layers and corresponding functions are provided:

Device layer 55 includes physical and/or virtual devices, embedded with and/or standalone electronics, sensors, actuators, and other objects to perform various tasks in a cloud computing environment 50. Each of the devices in the device layer 55 incorporates networking capability to other functional abstraction layers such that information obtained from the devices may be provided thereto, and/or information from the other abstraction layers may be provided to the devices. In one embodiment, the various devices inclusive of the device layer 55 may incorporate a network of entities collectively known as the "internet of things" (IoT). Such a network of entities allows for intercommunication, collection, and dissemination of data to accomplish a great variety of purposes, as one of ordinary skill in the art will appreciate.

Device layer 55 as shown includes sensor 52, actuator 53, "learning" thermostat 56 with integrated processing, sensor, and networking electronics, camera 57, controllable household outlet/receptacle 58, and controllable electrical switch 59 as shown. Other possible devices may include, but are not limited to various additional sensor devices, networking devices, electronics devices (such as a remote control device), additional actuator devices, so called "smart" appliances such as a refrigerator or washer/dryer, and a wide variety of other possible interconnected objects.

Hardware and software layer 60 includes hardware and software components. Examples of hardware components include: mainframes 61; RISC (Reduced Instruction Set Computer) architecture-based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provides cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provides pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and, in the context of the illustrated embodiments of the present invention, various workloads and functions 96 for real-time pollution control at a traffic junction. In addition, workloads and functions 96 for real-time pollution control at a traffic junction may include such operations as data analytics, data analysis, and as will be further described, notification functionality. One of ordinary skill in the art will appreciate that the workloads and functions 96 for real-time pollution control at a traffic junction may also work in conjunction with other portions of the various abstractions layers, such as those in hardware and software 60, virtualization 70, management 80, and other workloads 90 (such as data analytics processing 94, for example) to accomplish the various purposes of the illustrated embodiments of the present invention.

In one aspect, the mechanisms of the illustrated embodiments provide a novel approach for real-time pollution control at a traffic junction. In one aspect, an internet of things ("IoT") computing system may estimate both traffic and pedestrian flows, queues and pollution level. A maximum traffic volume threshold (i.e., demand) may be determined corresponding to a maximum tolerated pollution threshold according to one or more parameters and/or context (weather, background pollution, etc.). One or more control directives may be generated with bounded traffic volumes and with certain stability guarantees.

Various embodiments of the present invention can be directed to computer processing systems, computer-implemented methods, apparatus and/or computer program products that facilitate the efficient, effective, and autonomous (e.g., without direct human guidance) identification of traffic parameters and optimization of traffic flow at one or more traffic junctions, while also providing real-time pollution control at the one or more traffic injunctions. Furthermore, various embodiments described herein can comprise computer-implemented methods, systems, and computer products to facilitate autonomous control of heterogeneous traffic across one or more traffic junctions while also providing real-time pollution control at the one or more traffic injunctions. One or more embodiments of the present invention can optimize traffic flow across one or more traffic junctions based on customizable priority schemes and can consider traffic-adaptive turn ratios (e.g., the percentage of traffic turning left, turning right, or proceeding straight at a traffic junction) to provide real-time pollution control at the one or more traffic injunctions.

As used herein, "traffic route" can refer to a designated transportation area that can be utilized to facilitate travel from one destination to another destination. Example, traffic routes can include, but are not limited to: roadways, streets, trails, water-ways, and/or sidewalks. Also, as used herein "traffic" can refer to individuals traveling along a traffic route (e.g. pedestrians) and/or vehicles (cars, trains, trams, bicycles, motorcycles, buses, trolleys, boats, airplanes, off-road/utility vehicles, and/or other mobile objects), motorized or otherwise powered, that facilitate the transportation of individuals along a traffic route. Further, as used herein, "traffic junction" can refer to a meeting of two or more traffic routes. Example traffic junctions can include, but are not limited to: an intersection of roadways wherein traffic guidance devices (e.g., one or more traffic lights) control the flow of traffic across a junction formed by the merger of the roadways; and pedestrian cross-walks that traverse roadway intersections and/or mergers.

The computer processing systems, computer-implemented methods, apparatus and/or computer program products employ hardware and/or software to solve problems that are highly technical in nature (e.g., providing real-time pollution control at the one or more traffic injunctions), that are not abstract and cannot be performed as a set of mental acts by a human. The optimization of traffic flow and pollution control regulation at a traffic junction is complex and can change rapidly based on varying traffic parameters (e.g., amount of traffic and/or type of traffic and/or times of day that experience heavy or light traffic flow) and/or priorities (e.g., prioritization of traffic and/or special events occurring in proximity to the traffic junction). Traffic flow optimization and pollution estimation further increases in complexity as the traffic parameters at more and more traffic junctions are considered, and the complexity increases even further when traffic flow for one traffic junction is optimized in accordance with traffic flow from another traffic junction. By employing computer generated models, various embodiments described herein can analyze traffic parameters across one or more traffic junctions and optimize traffic flow while providing real-time pollution control at the one or more traffic injunctions with greater speed and accuracy than that of a human, or a plurality of humans. For example, one or more models generated by the computer processing systems, computer-implemented methods, apparatus and/or computer program products employing hardware and/or software described herein can express traffic flow as a multivariate polynomial that can facilitate identification and optimization of a traffic junction's phase sequences for providing real-time pollution control at the one or more traffic injunctions.

Figure 4A:
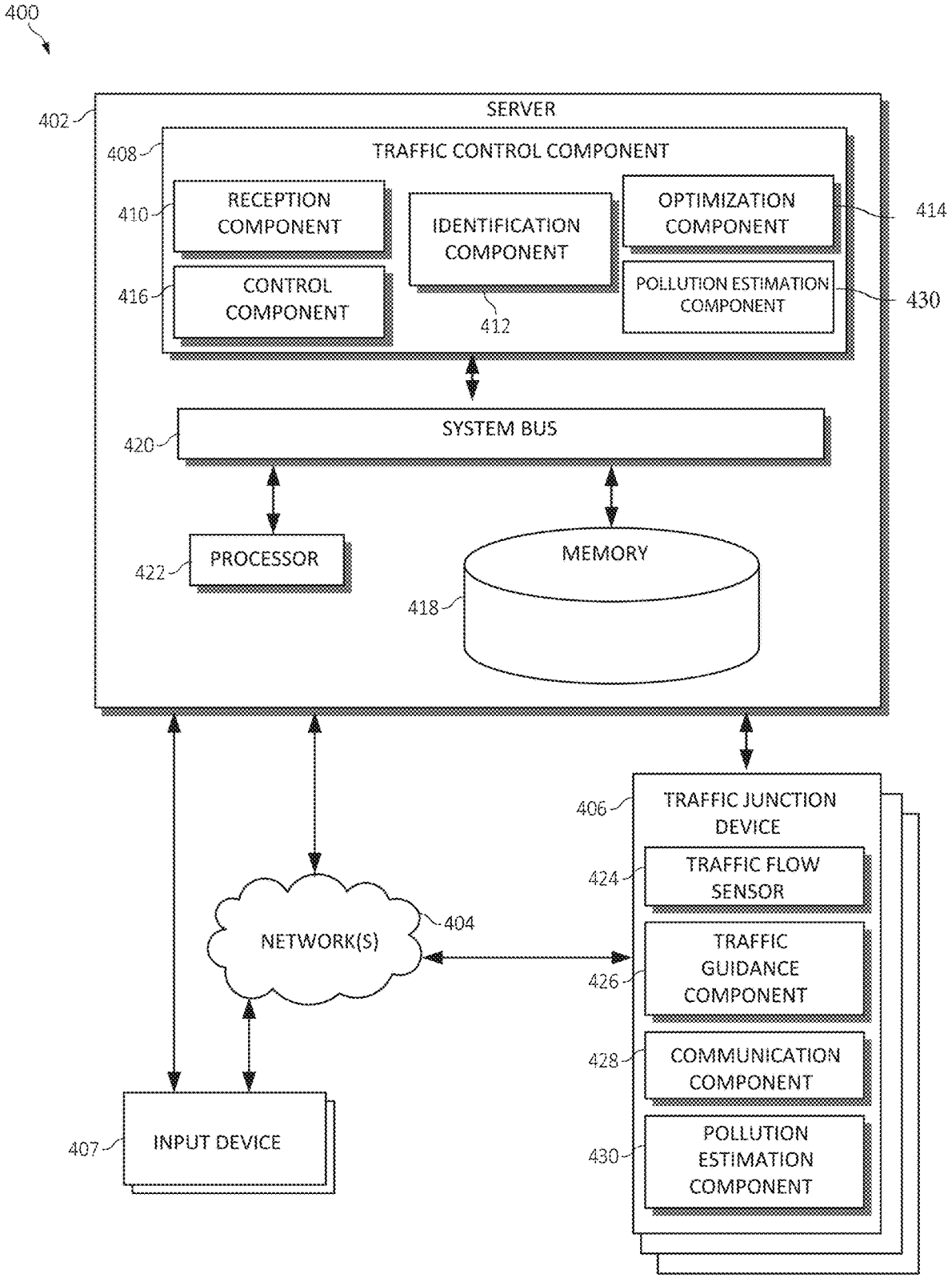
FIG. 4A illustrates a block diagram of an example, non-limiting system that identifies and optimizes phase sequences and controlling pollution in one or more traffic junctions in accordance with one or more embodiments described herein.

FIG. 4A illustrates a block diagram of an example, non-limiting system 400 that provides real-time control of pollution at one or more traffic injunctions. Also, system 400 may identify and optimize phase sequences in one or more traffic junctions such as, for example, for controlling pollution levels at one or more traffic injunctions. Repetitive description of like elements employed in other embodiments described herein is omitted for sake of brevity. Aspects of systems (e.g., system 400 and the like), apparatuses or processes in various embodiments of the present invention can constitute one or more machine-executable components embodied within one or more machines, e.g., embodied in one or more computer readable mediums (or media) associated with one or more machines. Such components, when executed by the one or more machines, e.g., computers, computing devices, virtual machines, etc. can cause the machines to perform the operations described.

As shown in FIG. 4A, the system 400 can comprise one or more servers 402, one or more networks 404, one or more traffic junction devices 406, and/or one or more input devices 407. The server 402 can comprise a traffic control component 408. In some embodiments, the traffic control component 408 can further comprise a reception component 410, identification component 412, optimization component 414, a control component 416, and/or a pollution estimation component 430. Also, the server 402 can comprise or otherwise be associated with at least one memory 418. The server 402 can further comprise a system bus 420 that can couple to various components such as, but not limited to, the traffic control component 408 and associated components, memory 418 and/or a processor 422. While a server 402 is illustrated in FIG. 4A, in other embodiments, multiple devices of various types can be associated with or comprise the features shown in FIG. 4A. Further, the server 402 can communicate with the cloud environment depicted in FIGS. 1-3 via the one or more networks 404.

The one or more networks 404 can comprise wired and wireless networks, including, but not limited to, a cellular network, a wide area network (WAN) (e.g., the Internet) or a local area network (LAN). For example, the server 402 can communicate with the one or more traffic junction devices 406 (and vice versa) using virtually any desired wired or wireless technology including for example, but not limited to: cellular, WAN, wireless fidelity (Wi-Fi), Wi-Max, WLAN, Bluetooth technology, a combination thereof, and/or the like. Further, although in the embodiment shown the traffic control component 408 can be provided on the one or more servers 402, it should be appreciated that the architecture of system 400 is not so limited. For example, the traffic control component 408, or one or more components of the traffic control component 408, can be located at another computer device, such as another server device, a client device, etc.

In some embodiments, the one or more traffic junction devices 406 can comprise one or more traffic flow sensors 424, a traffic guidance component 426, a communication component 428, and/or the pollution estimation component 430. The one or more traffic flow sensors 424 can identify traffic arriving and/or departing a respective traffic junction. In some embodiments, the one or more traffic flow sensors 424 can also determine a time at which identified traffic arrives and/or departs from a traffic junction. Further the one or more traffic flow sensors 424 can determine a first direction from which identified traffic arrives to a traffic junction and a second direction from which identified traffic departs from a traffic junction. Moreover, the one or more traffic flow sensors 424 can determine the type of traffic that arrives and/or departs a traffic junction. Example types of traffic include, but are not limited to: pedestrians, cars, emergency vehicles, trucks, semi-trucks, buses, trains, trams, trolleys, and/or boats.

The one or more traffic flow sensors 424 can comprise in-route sensors and over-route sensors. In-route sensors can be sensors embedded into the surface of a traffic route, embedded into a foundation of the traffic route, and/or attached to the traffic route. Example in-route sensors can include, but are not limited to: inductive-loop detectors, magnetometers, tape switches, turboelectric devices, seismic devices, inertia-switch devices, and pressure sensitive devices. Over-route sensors can be sensors located above a traffic route and/or alongside a traffic route (e.g., offset from the traffic route). Example over-route sensors can include, but are not limited to: video image processors (e.g., cameras), microwave radar devices, ultrasonic devices, passive infrared devices, laser radar devices, acoustic devices, GPS systems, and/or satellite systems (e.g., satellite imaging).

The one or more traffic flow sensors 424 can collect and/or determine data regarding traffic parameters at a traffic junction such as: types of traffic at the traffic junction, amount of traffic at the traffic junction, when each type of traffic at the traffic junction arrives and departs the traffic junction, and/or the route traveled through the traffic junction by each type of traffic identified at the traffic junction. Further, the one or more traffic flow sensors 424 can collect and/or determine the data over a defined cycle (e.g., starting from an action that permits traffic flow through an intersection and ending from an action that prohibits traffic flow) and/or a predetermined period of time (e.g., a period of time ranging from greater than or equal to one second to less than or equal to sixty seconds).

The traffic guidance component 426 can comprise one or more guidance signals that can identify when and/or how traffic is permitted to traverse a traffic route at a traffic junction. The guidance signals can be conveyed to traffic visually, audibly, and/or electronically. The flow of traffic at a traffic junction can be controlled via operation of one or more traffic guidance components 426. Example traffic guidance components 426 can include, but are not limited to: traffic lights (e.g., devices that can display shapes and/or colors), and/or crosswalk signs (e.g., devices that can display shapes and/or colors and generate an audible noise).

The communication component 428 can send the data collected and/or determined by the traffic flow sensor 424 and the status of one or more traffic guidance components 426 to one or more servers 402. The communication component 428 can be operably coupled to the server 402 and/or the communication component 428 can communicate with the server 402 via one or more networks 404. In an embodiment, the communication component 428 can communicate with the server 402 via a cloud environment such as the environment described herein with reference to FIGS. 1-3. The communication component 428 can be operably coupled to the traffic flow sensor 424 and/or the communication component 428 can communicate with the traffic flow sensor 424 via one or more networks 404. In an embodiment, the communication component 428 can communicate with the traffic flow sensor 424 via a cloud environment such as the environment described herein with reference to FIGS. 1-3. The communication component 428 can also be operably coupled to the traffic guidance component 426 and/or the communication component 428 can communicate with the traffic guidance component 426 via one or more networks 404. In an embodiment, the communication component 428 can communicate with the traffic guidance component 426 via a cloud environment such as the environment described herein with reference to FIGS. 1-3.

The one or more input devices 407 can be a computer device and/or means to enter data into a computer device. Example input devices 407 include, but are not limited to: a personal computer, a keyboard, a mouse, a computer tablet (e.g., a tablet comprising a processor and operating system), a smartphone, and/or a website. The input device 407 can be operably coupled to the server 402 and/or the input device 407 can communicate with the server 402 via one or more networks 404. An entity can provide one or more servers 402 with traffic parameters for a traffic junction via the input device 407. For example, a pedestrian at a traffic junction can identify a traffic parameter (e.g., traffic at the traffic junction is at a stand-still) and/or a condition (e.g., a sporting event is occurring near a traffic junction, and/or a traffic accident has occurred near a traffic junction) and send the traffic parameter to one or more servers 402 via an input device 407 (e.g., a smartphone).

The reception component 410 can receive data collected and/or determined by the traffic flow sensor 424, data regarding the status of the traffic guidance component 426 (e.g., current and/or past phase sequences of a respective traffic junction), and/or traffic parameters and/or conditions sent via an input device 407. The reception component 410 can be operably coupled to the server 402 and/or the reception component 410 can communicate with the server 402 via one or more networks 404. The reception component 410 can be operably coupled to the communication component 428 and/or the reception component 410 can communicate with the communication component 428 via one or more networks 404. Also, the reception component 410 can be operably coupled to the input device 407 and/or the reception component 410 can communicate with the input device 407 via one or more networks 404.

The identification component 412 can generate one or more piece-wise sinusoidal representations based on the information received by the reception component 410. The identification component 412 can determine traffic flow at one or more traffic junctions associated with a traffic junction device 406 and generate one or more sinusoid signals.

Moreover, the identification component 412 may collect, measure, store, and identify one or more types of pollutants, weather data, pollution concentrations, traffic volume data, and pollution threshold levels based on the information received by the reception component 410.

The pollution estimation component 430 may determine a pollution level at the traffic junction according to weather, traffic volume, traffic type, pollution measurements, topology, or a combination thereof. The pollution estimation component 430 may also determine a traffic volume threshold for the traffic junction to maintain the pollution level below a pollution threshold. The pollution estimation component 430 may also set one or more parameters of the traffic junction to maintain traffic volume below the traffic volume threshold.

Additionally, the pollution estimation component 430, in association with the optimization component 414, may compute maximum allowable traffic volumes per traffic junction to stay within pollution level bounds, and to optimize traffic for these obtained traffic volumes. The pollution estimation component 430 may also monitor data (real-time and historical) about pollution concentrations at one or more traffic junctions, weather data, topology of the city, traffic volumes at intersections, queue lengths, etc. For example, each intersection has a given capacity C. The pollution estimation component 430 determines a maximum traffic volume to guarantee the pollution levels are less than a pollution threshold, with the traffic volume also being equal to or less than capacity C, and where the pollution may be a function of the traffic volumes, weather, topology (e.g., pollution=f(trafficvolume, weather, topology)).

The pollution estimation component 430, in association with the optimization component 414, may optimize throughput for this given traffic volume by setting, adjusting, and/or controlling one or more traffic control signals (e.g., traffic lights). The pollution estimation component 430, in association with the optimization component 414, may return a maximum allowed time gap for pedestrians.

In an alternative embodiment, the pollution estimation component 430 may provide a pricing strategy for one or more traffic junctions (e.g., a "pay for traffic lights" strategy). The pollution estimation component 430 may compute the maximum allowable traffic volumes per traffic junction to stay within pollution level bounds. If the traffic demand exceeds the computed traffic volumes, the pollution estimation component 430 may implement a pricing strategy to influence the demand. In one aspect, the pollution estimation component 430 has access to and may monitor data (real-time and historical) about pollution concentrations at one or more traffic junctions, weather data, topology of the city, traffic volumes at intersections, queue lengths, etc.

Again, the pollution estimation component 430 determines a maximum traffic volume to guarantee the pollution levels are less than a pollution threshold with the traffic volume also being equal to or less than capacity C, where the pollution may be a function of the traffic volumes, weather, topology (e.g., pollution=f(trafficvolume, weather, topology)). When the observed and/or estimated traffic volume is greater than the maximum allowed traffic volume, the traffic demand may be influenced so as to reduce the demand. For example, a pricing and/or incentive strategy may be defined, and the pricing and/or incentive may be set to be nonzero if the estimated traffic volume is greater than the maximum traffic volume threshold. The pricing/incentive may increase with the amount of constraint violation (e.g., toll fees may increase to reduce the flow of traffic).

Figure 5:
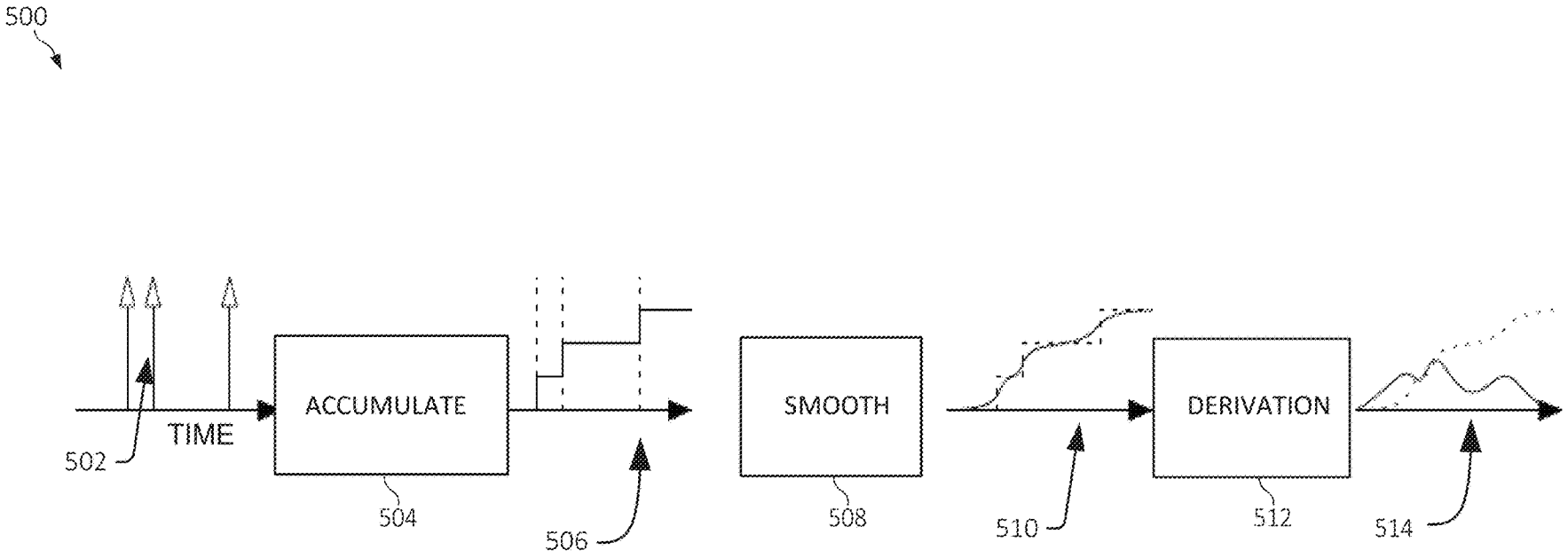
FIG. 5 illustrates a diagram of an example, non-limiting process that graphically expresses derivation of traffic arrival rates at a traffic junction in accordance with one or more embodiments described herein.

Other components of FIG. 4A are described below following the description of FIG. 5. FIG. 5 illustrates a block diagram of an exemplary, non-limiting process that can be performed by the identification component 412 to generate one or more sinusoid signals. Repetitive description of like elements employed in other embodiments described herein is omitted for sake of brevity. In one or more embodiments, the identification component 412 can utilize low-pass filtering 500 to generate one or more sinusoid signals based on information received by the reception component 410.

Information received by the reception component 410 can be expressed as one or more Dirac signals 502 (presented as vertical arrows in FIG. 5) over a period of time (e.g., over a period of 1 to 60 seconds). In some embodiments, the Dirac signals 502 can correspond to events collected and/or determined by the traffic flow sensor 424. For example, in some embodiments, a Dirac signal 502 can indicate the arrival and/or departure of traffic (e.g., a car) at a traffic junction. The identification component 412 can accumulate the Dirac signals at 504 to generate a staircase projection 506. Further the staircase projection 506 can be smoothed at 508 into a differentiable function 510, and a derivation at 512 can generate a derivative 514 that can represent the instantaneous arrival rate of traffic at the traffic junction.

The identification component 412 can utilize Equation 1 and Equation 2, presented below, to generate the derivative 514.

$$N(t_1,t_2)=\int_{t_1}^{t_2}\lambda(t)dt \tag{1}$$

$$N(t_1,t_2)=\Sigma_{i:t_1\le T_i\le t_2}=\int_{t_1}^{t_2}\Sigma\delta(t-T_i)dt \tag{2}$$

In Equations 1 and 2, N(t1, t2) can denote the number of events (e.g., Dirac signals 502) during a time interval [t1,t2], $T_i$ can denote event times (e.g., when traffic arrives at a traffic junction), and λ(t) can denote a continuous event rate.

The identification component 412 can determine an event rate by aggregation of the Dirac signals 502 and subsequent differentiation. The smoothing at 508 can be performed to the staircase projection 506, or alternatively, the smoothing at 508 can be interpolation by a monotonic piecewise cubic spline.

In another embodiment, the identification component 412 can utilize a Poisson model to generate one or more sinusoidal representations. The identification component 412 can assume that events at a traffic junction (e.g., arrival of traffic) are a non-homogenous Poisson process (NHPP) and utilize Equation 3 and Equation 4 below. In other words, through Equations 3-4, the identification component 412 can utilize NHPP to determine the instantaneous event rate, parametrized as $\lambda(t)=e^{h(t;\Theta)}$ (e.g., arrival rate of traffic at a traffic junction) for a time period.

$$prob(N(a,b)=n)=\frac{\left(\int_a^b\lambda(t)dt\right)^n}{n!}e^{-\int_a^b\lambda(t)dt} \tag{3}$$

-continued $$h(t;\Theta)=\sum_{i=0}^{m}\alpha_i t^i+\sum_{k=1}^{p}\gamma\sin(\omega_k t+\Phi_k) \tag{4}$$

where $$\Theta=[\alpha_0,\alpha_1,\ldots,\alpha_m,\gamma_1,\ldots,\gamma_p,\Phi_1,\ldots,\Phi_p,\omega_1,\ldots,\omega_p$$

In some embodiments, m can represent a degree of a polynomial function representing a general trend of the events over time, p can denote periodic components and represent trigonometric functions associated with cyclic effects, $\{\alpha_1,\ldots,\alpha_m\}$ can represent a parameter vector, $\{\gamma_1,\gamma_p\}$ can represent amplitudes of the Dirac signals 502, $\{\phi_1,\ldots,\phi_p\}$ can represent phases, and $\{\omega_1,\ldots,\omega_p\}$ can represent frequencies of the Dirac signals 502. Thus, a likelihood of a specific Θ given a sequence of event times can be found and a standard maximum likelihood estimation can yield an estimate for λ. In another embodiment, the identification component 412 can utilize finite-rate-of-innovation (FRI) methods to generate one or more sinusoid representations.

The identification component 412 can generate one or more sinusoid signals for each type of traffic identified by the traffic flow sensor 424. Further, the identification component 412 can concatenate multiple sinusoid signals to generate the piece-wise sinusoidal representation. The multivariate polynomial can be based on information received by the reception component 410. For example, the piece-wise sinusoidal representation can be based on, but not limited to: the amount of traffic identified by a traffic flow sensor 424; the time traffic arrives and/or departs from traffic junction; and the types of traffic at a traffic junction. Moreover, the identification component 412 may measure and identify one or more types of pollutants and/or pollution levels.

Referring again to FIG. 4A, in some embodiments, the optimization component 414 can optimize traffic flow at one or more traffic junctions based on pollution level thresholds, traffic volume thresholds, a layout of the traffic junctions subject to optimization, including a sequence of phases for each traffic junction, and/or one or more multivariate polynomials generated by the optimization component 414 based on a priority scheme that provides weights for different types of traffic. In some embodiments, the optimization component 414 can optimize traffic flow based further on network specific features such as turn ratios.

A sequence of phases at a traffic junction can comprise a series of phases, wherein each phase can represent a respective configuration of the traffic guidance component 426 associated with the subject traffic junction. The traffic guidance component 426 can have multiple configurations, wherein each configuration (or, in some embodiments, one or more of the configurations) permits a different traffic route to be traveled by traffic at the traffic junction. Thus, a traffic junction's phase sequence can comprise a first period in which a traffic route, which traverses the traffic junction, is permitted to be traveled by one or more identified traffic users and a second period in which the traffic route is prohibited to be traveled by one or more identified traffic users.

For example, a first phase at a traffic junction can comprise a period in which the traffic guidance component 426 permits traffic to cross the traffic junction in an east to west direction. Also, a second phase at the traffic junction can comprise a second period in which the traffic guidance component 426 prohibits traffic to cross the traffic junction in the east to west direction. Further, a phase sequence for the traffic junction can comprise the first phase and the second phase. In other words, a traffic junction's phase sequence can indicate the time and/or order in which traffic routes traversing the traffic junction are permitted and/or prohibited by the traffic guidance component 426.

The phase sequence can comprise phases that have occurred over a defined time and/or a cycle of phases. For example, a phase sequence can comprise one or more configurations of a traffic guidance component 426 that occurred during a period of time (e.g., the period of time can range from equal to or greater than 1 minute to less than or equal to 1 hour). In another example, a phase sequence can comprise one or more configurations of a traffic guidance component 426 that occurred during a cycle, wherein the cycle can be defined as a certain number of phases (e.g., a number of phases that can define a cycle can be equal to or greater than 2 and less than or equal to 20).

A layout of a traffic junction can comprise the total possible configuration of the traffic guidance component 426 for the traffic junction. In various embodiments, a layout of a traffic junction can include, but is not limited to: the number of possible traffic routes at the traffic junction, the direction of the possible traffic routes at the traffic junction, and the traffic guidance component 426 capacity (e.g., which traffic routes the traffic guidance component 426 is capable of controlling). The layout and phase sequence of a traffic junction can be provided to the optimization component 414 by the traffic junction device 406 (e.g., the traffic guidance component 426 and/or the communication component 428) via the one or more networks 404 and/or the reception component 410.

The optimization component 414 can be operably coupled to the identification component 412 and/or the optimization component 414 can communicate with the identification component 412 via the one or more networks 404. Further, the optimization component 414 can be operably coupled to the memory 418 and/or the optimization component 414 can communicate with the memory 418 via the one or more networks 404. In one or more embodiments, the optimization component 414 can receive one or more multivariate polynomials generated by the identification component 412 directly from the identification component 412. In various embodiments, the identification component 412 can store one or more of the generated multivariate polynomials in the memory 418, and the optimization component 414 can retrieve one or more of the stored multivariate polynomials from the memory 418.

In one or more embodiments, a priority scheme can be sent to the server 402 by an input device 407 either directly or via one or more networks 404 and provided to the optimization component 414 via the reception component 410. In various embodiments, one or more priority schemes can be stored in the memory 418, and the optimization component 414 can retrieve the one or more priority schemes from the memory 418. A priority scheme can prioritize traffic flow based on a type of traffic, a time of day, a queue length of traffic at a traffic junction, and/or a special event (e.g., an event that will alter normal traffic conditions, such as a sporting event and/or a parade). For example, a priority scheme can indicate that one type of traffic (e.g., buses) identified at a traffic junction has a higher priority than another type of traffic (e.g., cars) at the traffic junction. The optimization component 414 can optimize traffic flow based on one or more types of traffic that are highly prioritized, as indicated by the priority scheme.

In various embodiments, the priority scheme can be represented as a polynomial function, and thereby be considered by the optimization component 414 as a polynomial objective. As used herein, a "polynomial objective" can refer to a polynomial function that indicates a prioritization of one or more variables of traffic at a traffic junction. One or more variables of traffic at a traffic junction include but are not limited to: one or more types of traffic, one or more queue lengths for respective traffic types, a number of operational traffic junctions subject to optimization by the optimization component 414, one or more events (e.g., a sporting event or a parade), and/or the location of one or more parking lots.

Data that can be provided by the traffic guidance component 426, and/or derived from data provided by the traffic guidance component 426, and analyzed by the optimization component 414 can include, but is not limited to: a number of traffic junctions subject to optimization (e.g., two or more traffic junctions); a number of traffic routes that link the traffic junctions subject to optimization together; and/or a number of phases available at each traffic junction (e.g., one or more phase sequences).

Further, data that can be provided by the traffic flow sensor 424 in conjunction with the identification component 412 and analyzed by the optimization component 414 can include, but is not limited to: an amount of traffic in queue at a traffic junction and the direction of the traffic in queue (e.g., an indication of the length of a queue at a traffic junction and/or an indication of the direction to which the queue extends); an amount of traffic (e.g., number of vehicles) arriving at a traffic junction from a destination other than another traffic junction in the subject optimization; an amount of traffic (e.g., number of vehicles) at a traffic junction at a point in time, including traffic originating from another traffic junction subject to optimization and traffic not originating from another traffic junction subject to optimization; a ratio of traffic (e.g., number of vehicles) at a traffic junction that indicate a desire to go in a particular direction (e.g., traffic indicating a desire to travel straight, traffic indicating a desire to turn left, and/or traffic indicating a desire to turn right); and/or an amount of traffic (e.g., number of vehicles) departing a traffic junction via a traffic route that does not lead to another traffic junction subject to optimization.

The optimization component 414 can generate, based on the information provided, collect, and/or determine, one or more multi-variate polynomials. For example, the optimization component 414 can generate a multi-variate polynomial based on: one or more piece-wise sinusoidal representations generated by the identification component 412; one or more priority schemes; and/or information collected and/or derived from one or more traffic junction devices 406. The multi-variate polynomial can distinguish between one or more average queue lengths of one or more traffic types at one or more traffic junctions over one or more phase sequence. Also, the multi-variate polynomial can describe one or more time delays of traffic at one or more traffic junctions over a period of time (e.g., one or more phase sequences). The time delay can be relative to one or more time tables and/or one or more desired routes. A route can be desired because it is perceived to be the fastest route to a destination from a traffic junction. In one or more embodiments, the time table and/or the desired route can be stored in the memory 418 and retrieved by the optimization component 414 and/or can be sent to the server 402 via the input device 407.

Also, the optimization component 414 can generate, based on the information provided, collect, and/or determine, one or more control directives to be implemented by one or more traffic junction devices 406 in order to optimize traffic flow. The optimization component 414 can make various assumptions in generating the one or more control directives. First, the optimization component 414 can assume that each traffic junction subject to optimization has a common cycle time and a common frequency of a phase sequence. Second, the optimization component 414 can assume that exogenous arrivals into a traffic network are piece-wise sinusoidal processes of the same frequency, wherein the traffic network comprises the traffic junctions subject to optimization and linked together by common traffic routes. In other words, the optimization component 414 can consider the traffic as switched systems, where exogenous arrivals and departures to the traffic network can be periodic processes of the same frequency, but where after each switch the exogenous arrivals or departures can have distinct amplitudes and time changes across the sinusoidal signals.

The switch can represent a distinct change in traffic volumes at a subject traffic junction. The switch can be derived from historical data and/or current events (e.g., the occurrence of a traffic accident or a public event). For example, the switch can represent a change from a rush hour period (e.g., a period of time in which a traffic junction can experience a large amount of traffic due at least to individuals traveling to or from their respective workplaces at the same time) to a non-rush hour period (e.g., a period of time in which a traffic junction experiences a smaller amount of traffic as compared to the rush hour period). Thus, a switch at a traffic junction can mark a change in the average amount of traffic arriving and serviced by the traffic junction.

Third, the optimization component 414 can assume that for each description of the exogenous arrivals and departures, there can exist a finite minimum duration, such that between two switches of the second assumption, there can be at least the minimum duration.

Fourth, the optimization component 414 can assume that the average of periodic exogenous arrival rates e(t) to a traffic network, wherein the traffic network comprises the traffic junctions subject to optimization and linked together by common traffic routes, can be a vector by Equation 5.

$$\bar{e} = \frac{1}{T}\int_0^T e(t)dt \in R^Q \tag{5}$$

In Equation 5, Q can be the number of traffic queues at a traffic junction and denote further the vector of service rates c(t) and the average service rate by Equation 6, wherein the service rate can represent an amount of traffic passing through the traffic junction.

$$\bar{c} = \frac{1}{T}\int_0^T c(t)dt \in R^Q \tag{6}$$

Additionally, the optimization component 414 can assume that, on average for every queue, the service rate exceeds the total arrival rate by a value ε, wherein ε>0, as represented by Equation 7.

$$\bar{c} > (I - R^T)^{-1}\bar{e} + \varepsilon 1 \tag{7}$$

In Equation 7, R can represent a matrix with an amount of traffic (e.g., number of vehicles) desiring to go a particular direction at a traffic junction. Fifth, the optimization component 414 can assume that each arriving traffic leaves the subject traffic network, wherein the traffic network comprises the traffic junctions subject to optimization and linked together by common traffic routes, after visiting a finite number of traffic junctions subject to optimization. Assumptions two through five can ensure that after each switch (e.g., from a morning rush-hour to a non-rush-hour), transients decay quickly and a stationary limit cycle (e.g., periodic queue lengths at each traffic junction subject to optimization) is followed for most of the interval between switches.

The optimization component 414 can generate a model that converges to a unique periodic orbit. Further the unique periodic orbit can exhibit the following characteristics: (i) after each switch, the model can stabilize to a unique periodic state trajectory with a period dependent on the choice of optimization (e.g., in accordance with a priority scheme); (ii) an average queue length in the periodic stat trajectory can be well-approximated by a product-form solution; and (iii) independently of the average queue length in the periodic state trajectory each queue is cleared at least once within the state trajectory. For any segment that makes up the multivariate polynomial, there exists a finite bound on the convergence, which assumption three assures that no switch occurs prior to the convergence. The optimization component 414 can then optimize one or more properties of the periodic orbit based on the multivariate polynomial. For example, the optimization component 414 can minimize the square of the average queue length at each traffic junction over the periodic orbit by minimizing a difference between the traffic arrival offset between traffic junctions.

Further the optimization component 414 can formulate one or more optimization objectives, per traffic type, in terms of one or more trigonometric functions of the phase offsets. Example optimization objectives can include, but are not limited to: an average amount of one or more traffic types in queue at a traffic junction over a period of time; an average amount of one or more traffic types in queue at a traffic junction over a phase sequence; an average amount of delay of one or more traffic types in queue at a traffic junction over a period of time; and an average amount of delay of one or more traffic types in queue at a traffic junction over a phase sequence. Further, the optimization component 414 can reformulate the trigonometric functions to polynomials.

For example, in various embodiments, the optimization component 414 can optimize traffic flow across a traffic network comprising N number of traffic junctions. Each traffic junction in the traffic network can be associated with a sequence of phases, and one traffic junction in the traffic network can serve as a reference. The identification component 412 can generate a (kN)-variate polynomial for each traffic type of k number of traffic types. The optimization component 414 can optimize the offset of a first phase of the sequence of phases at each traffic junction in the traffic network relative to the reference traffic junction with respect to the average of the (kN)-variate polynomial over time. Wherein the variables of the one or more polynomials can comprise parameters of each traffic type at each traffic junction in the traffic network at a given time. Moreover, the optimization component 414 can generate control directives that when actualized by one or more traffic junction devices 406 will result in realization of the optimizations determined by the optimization component 414. In one or more embodiments, the optimization component 414 can also consider varying turn ratios as a bi-level optimization problem, wherein the turn ratios are at the lower level of the optimization problem and the phase offsets are at the upper level of the optimization problem.

In one or more embodiments, the optimization component 414 can generate control directives that optimize traffic flow by minimizing offsets between traffic junctions. For example, the optimization component 414 can vary an offset between phase sequences between traffic junctions. Further, the optimization component can vary offsets based on one or more traffic types to prioritize traffic flow of one or more traffic types (e.g., two traffic types) over one or more other traffic types (e.g., a third traffic type). In other words, the optimization component 414 can generate the multi-variate polynomial optimization problem and minimize polynomial objectives (e.g., in accordance with a priority scheme) where the variables are the offsets (or other parameters). The optimization component 414 can then generate new offsets between phase sequences of one or more traffic junctions as control directives to optimize a traffic flow amongst the traffic junctions.

The control component 416 can send the control directives generated by the optimization component 414 to the one or more traffic junction devices 406. As the traffic junction devices 406 implement the control directives, traffic flow amongst the one or more traffic junctions associated with the one or more traffic junction devices 406 can be optimized in accordance with the optimization objectives considered by the optimization component 414. The control component 416 can be operably coupled to the optimization component 414, and/or the control component 416 can communicate with the optimization component 414 via the one or more networks 404. Further, the control component 416 can be operably coupled to the one or more traffic junction devices 406 and/or the control component 416 can communicate with the one or more traffic junction devices 406 via the one or more networks 404.

Moreover, the mechanisms of the illustrated embodiments further address the effect of a queue spillback from a downstream traffic junction or demand starvation from an upstream traffic junction. That is, the feasibility of setting offsets close to the maximum traffic flow capacity is provided. Accordingly, the mechanisms of the present invention do not assume that the travel time from one traffic junction to another traffic junction is either zero or a constant, but rather provide a non-decreasing function of the number of users of the roads.

In one aspect, the following notations may be applicable. S may be a set of intersections. $\mathcal{L}$ may be the set of links between the intersection, i.e., the lanes. It should be noted that it may be possible to have l, l'$\in\mathcal{L}$ with the same head and tail node yet may not be equal. Some links have no tail, those are the entry links $\varepsilon\subset\mathcal{L}$. For each $l\in\mathcal{L}$, $\sigma(l)\in S$ is the intersection at which the link ends, whereas $\tau(l)\in L\cup\{\epsilon\}$ is where the link originates (e.g., $\tau(l)=\epsilon\Leftrightarrow l\in\varepsilon$). Link travel times may be $\lambda_l$.

Each intersection may have an offset $\theta_s$ from a global zero clock. For each link $l\in\mathcal{L}$, an associated green split ($\gamma_l$) in each cycle may be the midpoint of the interval $\theta_{\sigma(l)}+\gamma_l$ during which its queue $q_l$ is actuated (e.g., the corresponding traffic signal light is green). The turn ratio $\beta_{lm}$ defines which proportion of cars queueing at l will turn into m, once the light turns green. $\sum_{m\in\mathcal{L}}\beta_{lm}\leq 1$, and the inequality is strict only if cars can leave the road network at $\sigma(l)$.

The goal is to suggest the phase offset of $\theta_l(t)$ at $l\in\mathcal{L}$. In so doing, one or more assumptions may be performed. In Assumption 1, for common cycle time, all traffic signals at all intersections may have a common cycle time T and common frequency $\omega=2\pi/T$. For the sake of simplicity, additional assumptions may be assumed that are more restrictive such as, for example, Assumption 2, which is a periodicity Assumption, with the traffic network in a periodic steady state so that all arrivals, departures, and queues are periodic with period T (e.g., common cycle time T). In one aspect, an assumption may be a constant link travel time assumption, and the link travel times $\lambda_l$ may be constant.

In a Queuing process, queues may be modelled as simple integrators, integrating the difference between departures and arrivals as represented by Equation 8.

$$\dot{q}_e=a_l(t)-d_l(t) \tag{8}$$

For entry link arrivals, since all signals—arrivals, departures and queues—are assumed to be periodic, all signals may be represented by the Fourier series of the signals (e.g., for an entry link $l\in E$ as represented by Equation 9).

$$a_l(t)=a_{l0}+\Sigma_{k\neq 0}a_{lk}e^{jwk(t-\phi_l)} \tag{9}$$

where the term $a_{l0}>0$ is the average arrival rate, whereas assuming $a_{lk}\in\mathbb{R}$ and the inclusion of $\phi_l$ guarantees even symmetry around $\phi_l$ and extrema at $$t=\phi_\ell\frac{N\pi}{w},$$

Figure 4B:
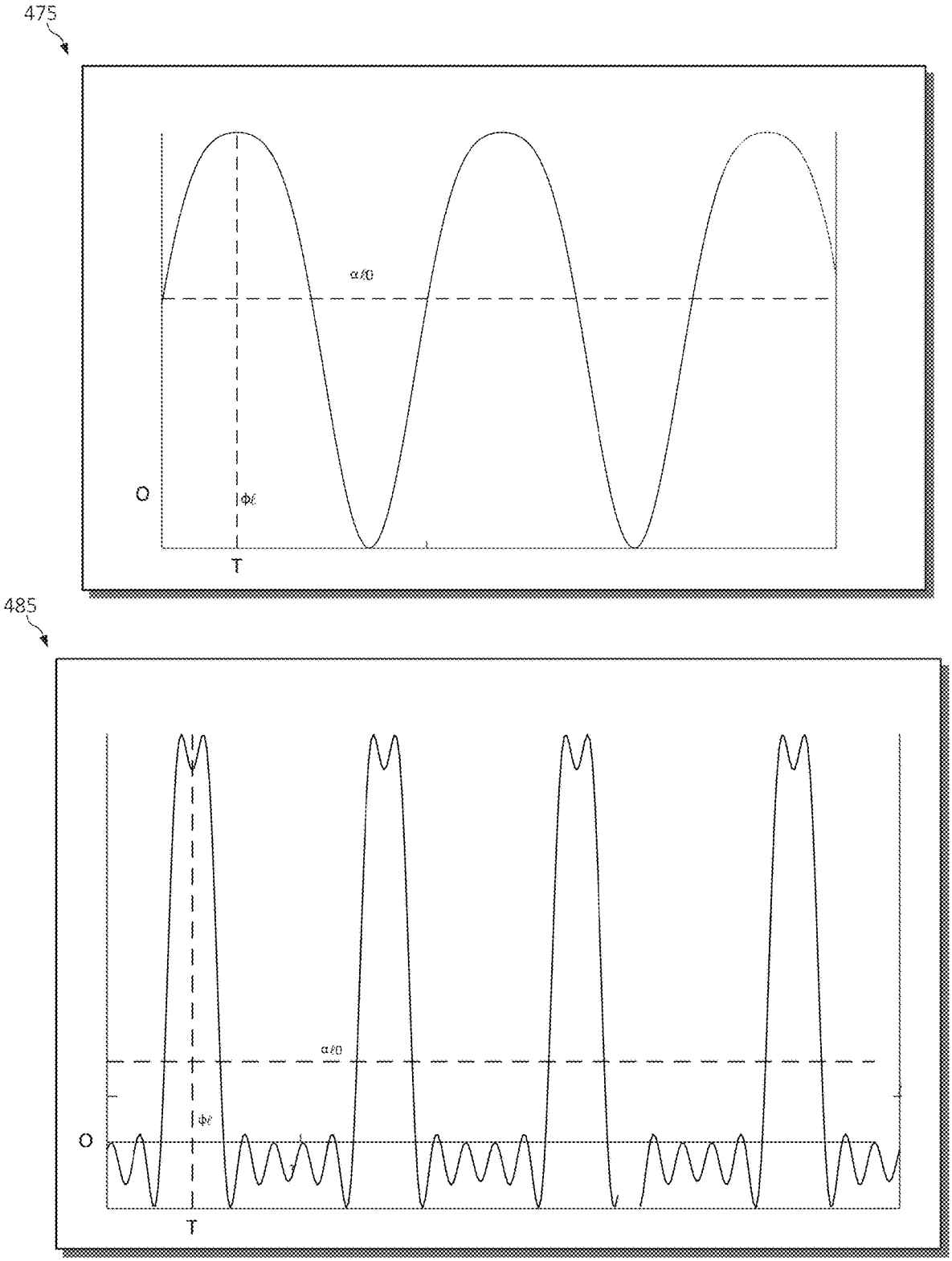
FIG. 4B illustrates graph diagrams of examples of arrival processes described in a Fourier series with real coefficients and a shift and also an example of pulse approximation in accordance with one or more embodiments described herein.

$N\in\mathbb{Z}$, as illustrated in example graphs 475 and 485 of FIG. 4B. That is, FIG. 4B illustrates graph diagrams 475 and 485 of examples of arrival processes described in a Fourier series with real coefficients and a shift $\phi_l$ and with graph 485 illustrating how a pulse approximation (with example graph 485 having a 25% duty cycle) may be approximated with $k=\{1, \ldots, 5\}$.

For all link departures, it may be assumed for any link e that a departure process is even-symmetric about $\theta_{\sigma(l)}+\gamma_l$ (e.g., symmetric about a center of an interval during which a traffic signal light is green), which may be represented by Equation 10.

$$d_l(t)=\delta_{l0}+\Sigma_{k\neq 0}\delta_{lk}e^{jwk(t-\theta_{\sigma(l)}-(\gamma l))}=\delta_{l0}+\Sigma_{k\neq 0}\delta_{lk}e^{jwk\theta_{\sigma(l)}} \tag{10}$$

and because a periodic steady state is assumed, there can be no accumulation of queue on average (e.g., the average of the departure and arrival processes must be equal for each link as represented by Equation 11).

$$\delta_{l0}=a_{l0}\forall l\in\mathcal{L} \tag{11}$$

where it should be noted, that equation 11 is the only dependence of $d_l$ on $a_l$ that is being assumed.

For non-entry link arrivals, the arrival process of interior links $l\in\mathcal{L}\setminus\varepsilon$. The assumption here is that the arrivals at queue $q_l$ are the sum of all the departures from the links feeding into l after travelling through l (which takes $\lambda_l$) according to the turn ratios as represented by Equation 12:

$$a_\ell(t)=\sum_{m\in\mathcal{L}}\beta_{\ell m}d_m(t-\lambda_\ell)=\sum_{m\in\mathcal{L}}\left[\beta_{\ell m}\delta_{m0}+\sum_{k\neq 0}\delta_{\ell m}e^{jwk\left(t-\theta_{\sigma(m)}-\gamma_m-\lambda_\ell\right)}\right]=\sum_{m\in\mathcal{L}}\beta_{\ell m}a_{m0}+\sum_{k\neq 0}\left\{\sum_{m\in\mathcal{L}}\beta_{\ell m}\delta_{mk}e^{-jwk(\gamma_m+\lambda_\ell)}\right\}e^{-jwk\theta_{\tau(\ell)}}e^{jwkt}=a_{\ell 0}+\sum_{k\neq 0}\alpha'_{\ell k}e^{-jwk\theta_{\tau(\ell)}}e^{jwkt}, \tag{12}$$

where $\alpha'_{lk}$ is defined by the term between curly brackets "{ }" and denotes the Fourier coefficients of the fluctuating part of the arrival process up to the explicit phase shift $e^{-jwk\Theta_{T(l)}}$. Also, $\beta_{lm}$ is set as not equal to zero (e.g., $\beta_{lm}\neq 0$) only if $\sigma(m)$ is equal to $\tau(l)$. It should also be noted that $\alpha'_{lk}$ may not necessarily be a real signal or number at this point, but that there needs to be $\alpha'_{lk}=\overline{\alpha'_{l-k}}$ in order to have real signals. Together with equations 11 and 12, one or more constraints may be introduced as represented by Equation 13.

$$\sum_{m\in\mathcal{L}} \beta_{lm}a_{m0}=a_{l0}\,\forall l\in\mathcal{L} \quad (13),$$

or in a matrix-vector notation as represented by Equation 14.

$$\alpha_{:0}=B^T\alpha_{:0} \quad (14),$$

where $[B_{mi}]=B_{mi}$ and $B_{mi}$ is the matrix of turn ratios and $\alpha_{:k}$ denotes the column vector as represented by Equation 15.

$$\begin{bmatrix} a_{1k} \\ a_{2k} \\ \vdots \\ a_{Lk} \end{bmatrix}, \quad (15)$$

However, the situation here is covered by Proposition 1, below, as defined herein. For Proposition 1, it may be defined that for every set $\{a_{l0}|l\in\mathcal{L}\}$ of average arrivals at the entry links there is a unique set of average arrivals $\{a_{l0}|l\in\mathcal{L}\setminus E\}\}$ such that equation 14 is satisfied.

For queue lengths, as an added convenience, $\mathcal{Z}_s=e^{-jw\Theta_s}$, hence $|\mathcal{Z}_s|=1$ (hence, an element of the unit circle in the complex plane). With these definitions, queue lengths may be obtained as represented by Equations 16-17.

$$q_\ell(t)=\sum_{k\neq 0} a'_{\ell k}Z^k_{\tau(\ell)}e^{jwkt}-\delta_{\ell 0}-\sum_{k\neq 0}\delta_{\ell k}e^{-jwk\gamma_\ell}Z^k_{\sigma(\ell)}e^{jwkt}\sum_{k\neq 0}a'_{\ell k}Z^k_{\tau(\ell)}-\delta_{\ell k}e^{-jwk\gamma_\ell}Z^k_{\sigma(\ell)}e^{jwkt}, \quad (16)$$

$$q_\ell(t)=\sum_{k\neq 0}(a'_{\ell k}Z^k_{\tau(\ell)}-\delta_{\ell k}-e^{-jwk\gamma_\ell}Z^k_{\sigma(\ell)})\frac{e^{jwkt}}{jwk}+\sum_{k\neq 0}\frac{j}{wk}\Big(\sum_{k\neq 0}(a'_{\ell k}Z^k_{\tau(\ell)}-\delta_{\ell k}e^{-jwk\gamma_\ell}Z^k_{\sigma(\ell)}). \quad (17)$$

for or $l\in\mathcal{L}$, $a_{lk}$ may be used instead of $\alpha'_{lk}$. In equation 17, the first term may represent a fluctuating part of the queue lengths, the average over one cycle may be zero, whereas the second term may represent the average queue length as represented by Equation 18.

$$C_\ell:=\sum_{k\neq 0}\frac{j}{wk}(a'_{\ell k}Z^k_{\tau(\ell)}-\delta_{\ell k}e^{-jwk\gamma_\ell}Z^k_{\sigma(\ell)}), \quad (18)$$

It should be noted that the average arrival rates $a_{lk}$ do not appear explicitly in equation 17) nor do they do not appear in the expression for $\alpha'_{lk}$. The average arrival rates $a_{lk}$ implicitly restrict the fluctuating parts of the processes (although obviously, real queue lengths and arrival/departure rates can never be negative). Apart from this, the assumption of periodic steady state may remove the averages from the expressions.

For optimizations problems in q(t), the optimizing function of $q=[q_1 \ldots, q_L]^T$, where the problem data is considered as: a) the coefficients $a_{lk}$, $l\in E$ of the arrival rates at the entry links, b) the coefficients $\delta_{lk}$, $l\in\mathcal{L}$, $k\neq 0$, of the fluctuating part of the departure processes; and c) network topology, traffic light signal green splits, turn ratios, and link travel times as defined herein, frequency as postulated in Assumption 1.

The coefficients $\alpha'_{lk}$ are computed as in equation 12. The average queue length C may be a vector of polynomials with complex coefficients in the complex numbers $\mathcal{Z}_s$. For instance, the present invention may minimize a weighted norm of the average queue lengths as represented by Equation 19:

| | |
|---|---|
| $\text{minimize}_{z\in\mathbb{C}^s}$ | $Y=\|PC\|$ |
| Subject to | $\mathcal{Z}^*\cdot\mathcal{Z}=1$ (in other words $\|\mathcal{Z}_s\|=1\ \forall s\in S$) (19), |

where P is greater than zero (e.g., P>0) and is a weighting matrix such as, for example, a diagonal matrix assigning a large penalty to the queues on bus lanes of a road network. Neither the cost nor the constraint $\mathcal{Z}^*\cdot\mathcal{Z}=1$ are convex. A cost function and decision variables can be rewritten in real form (by writing $\mathcal{Z}_s=X_s+jY_s$ and so forth). The phase offsets $\theta_s$ can be obtained as $\theta_s=-\arg(\mathcal{Z}_s)=a\tan_2(-Y_s,X_s)$.

In one aspect, for rewriting $C_l$ using parameters$\in$R, equation 18 may be rewritten in terms of only real parameters and variables by using the following results.

Definition 2 (Chebyshev Polynomials, trigonometric definition). Let $T_n(\phi)$, or $U_n(\phi)$, n=0, 1, . . . , denote Chebyshev Polynomials of the first or second kind and can be defined as the unique polynomials satisfying:

$$\cos(n\phi)=T_n(\cos(\phi))$$

$$\sin(n\phi))=\sin(\phi))U_{n-1}(\cos(\phi))$$

(DeMoivre's Formula).

$$\cos(\phi)+j\sin(\phi))^n=\cos(n\phi)+j\sin(n\phi).$$

If z=x+jy and |z|=1, then $$\mathrm{Re}(\mathcal{Z}^k)=T_k(x) \quad (20),$$

$$Im(\mathcal{Z}^k)=yU_{k-1}(x) \quad (21),$$

Thus, equation 18 may be rewritten as represented by Equation 22.

$$w/j\,C_\ell:=\sum_{k>0}\frac{1}{k}(\alpha'_{\ell k}Z^k_{\tau(\ell)}-\delta_{\ell k}e^{-jwk\gamma_\ell}Z^k_{\sigma(\ell)}-a'_{\ell(-k)}Z^{-k}_{\tau(\ell)}+\delta_{\ell(-k)}e^{jwk\gamma_\ell}Z^{-k}_{\sigma(\ell)})\sum_{k>0}\frac{2j}{k}(\mathrm{Im}(\alpha'_{\ell k})\mathrm{Re}(Z^k_{\tau(\ell)})+\mathrm{Re}(\alpha'_{\ell k})\mathrm{Im}(Z^k_{\tau(\ell)})-\mathrm{Im}(\delta_{\ell k}e^{-jwk\gamma_\ell})\mathrm{Re}(Z^k_{\sigma(\ell)})-\mathrm{Re}(\delta_{\ell k}e^{-jwk\gamma_\ell})\mathrm{Im}(Z^k_{\sigma(\ell)})), \quad (22)$$

Using equations (20) and (21) as depicted previously, a polynomial in the real and imaginary parts of $\mathcal{Z}_s=X_s+jY_s$ may be obtained as represented by Equation 23.

$$C_\ell := \frac{2}{w}\sum_{k>0}\frac{1}{k}(\mathrm{Im}(\delta_{\ell k}e^{-jwk\gamma_\ell})T_k(x_{\sigma(\ell)}) + \mathrm{Re}(\delta_{\ell k}e^{-jwk\gamma_\ell})y_{\sigma(\ell)}U_{k-1}(x_{\sigma(\ell)}), \quad (23)$$

It should be noted that all coefficients at this point may be real and readily obtained from the problem data ($\alpha'_{lk}$ is defined in equation 12, and for $l \in E$ it is given) and, thus, by restricting to N harmonics (e.g., terminate the Fourier series after the k=N), then $C_l$ is a polynomial of order N in the 2S variables $X_s$, $Y_s$. The functions $\sigma(\bullet)$ and $\tau(\bullet)$ are a reordering and encode the structure of the underlying road network (e.g., an incidence matrix). However, if the trigonometric version is desired to be, the following may be used $X_s = \mathrm{Re}(\mathcal{Z}_s) = \cos(\omega_s)$ and $Y_s = \mathrm{Im}(\mathcal{Z}_s) = -\sin(\omega\theta_s)$ to achieve equation 24:

$$C_\ell := \frac{2}{w}\sum_{k>0}\frac{1}{k}(\mathrm{Im}(\delta_{\ell k}e^{-jwk\gamma_\ell})\cos(k\omega\theta_{\sigma(\ell)}) - \mathrm{Re}(\delta_{\ell k}e^{-jwk\gamma_\ell})\sin(k\omega\theta_{\sigma(\ell)}) - (\mathrm{Im}(\alpha'_{\ell k})\cos(k\omega\theta_{\sigma(\ell)}) + \mathrm{Re}(\alpha'_{\ell k})\sin(k\omega\theta_{\sigma(\ell)}), \quad (24)$$

so as to rewrite equation 19 as:

$$\begin{array}{ll} \text{minimize}_{x,y\in\mathbb{R}^S} & Y = \|PC\| \\ \text{Subject to} & x_s^2 + x = y_s^2 = 1 \ \forall s \in S \end{array} \quad (25),$$

where C is defined by the elements $C_l$ and P>0 is a weighting matrix of a user choice.

For split as a variable, it should be noticed that in equation 23, the split may come in as $\gamma_e$ in $e^{-jwk\gamma_l}$. From Euler's formula, it is known that $e^{inx} = \cos(\gamma_l(kw)) + j\sin(\gamma_l(kw))$. It should also be noted that the Chebyshev recurrence is:

$$\cos(nx) = \mathrm{Re}(e^{inx}) = \cos[(n-1x)]*[2\cos(x)] - \cos[(n-2)x]$$

Figure 6:
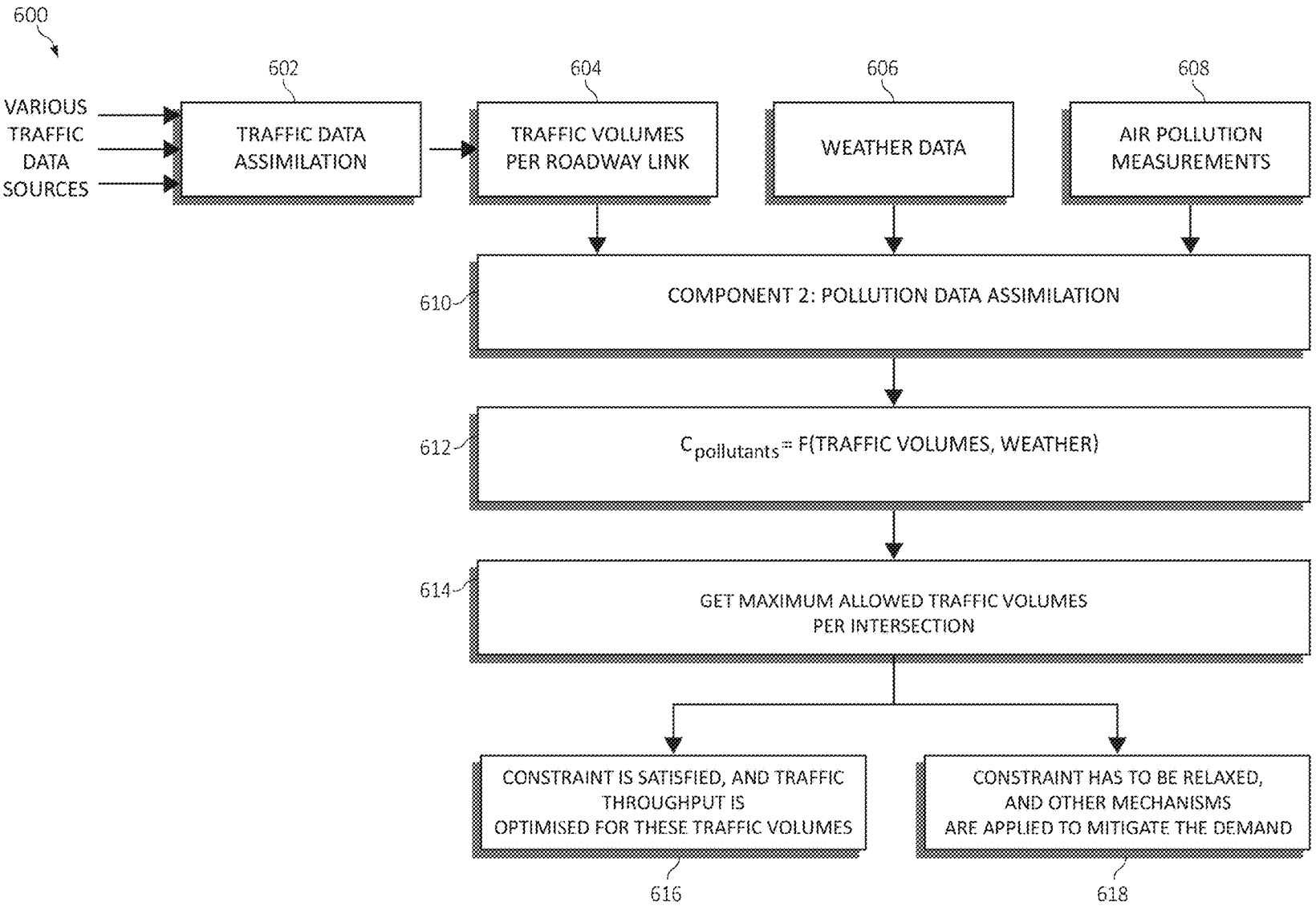
FIG. 6 illustrates a block flow diagram of an example for controlling pollution at a traffic junction in accordance with one or more embodiments.

Turning now to FIG. 6, a block diagram of exemplary functionality 600 relating to controlling pollution at a traffic junction is depicted. As shown, the various blocks of functionality are depicted with arrows designating the blocks' 600 relationships with each other and to show process flow. Additionally, descriptive information is also seen relating each of the functional blocks 600. As will be seen, many of the functional blocks may also be considered "modules" of functionality, in the same descriptive sense as has been previously described in FIG. 1-5. With the foregoing in mind, the module blocks 600 may also be incorporated into various hardware and software components of a system for image enhancement in accordance with the present invention. Many of the functional blocks 600 may execute as background processes on various components, either in distributed computing components, or on the user device, or elsewhere.

Starting with block 602, traffic data may be assimilated from one or more traffic data sources. As indicated in block 604, the assimilated traffic data from block 602 may be used to determine the traffic volumes per roadway (e.g., roadway link). From blocks 604, 606, and 608, the traffic volumes per roadway (e.g., roadway link), weather data, and air pollution measurements may be used as input for pollution data assimilation, as in block 610. At block 612, a pollution threshold constraint "$C_{pollutants}$" may be determined as equal to a function of one or more parameters such as, for example, the traffic volume and weather (e.g., $C_{pollutants}$=f (traffic volumes, weather). A maximum traffic volume threshold may be determined per traffic junction (e.g., intersection), as in block 614. From block 614, if the pollution threshold constraint "$C_{pollutants}$" is satisfied (e.g., pollution level and/or traffic volumes do not exceed the pollution threshold constraint or maximum traffic volume threshold), the traffic throughput in a traffic junction is determined to be optimized, as in block 616. Alternatively, if the pollution threshold constraint "$C_{pollutants}$" is required to be adjusted (e.g., relaxed and/or raised), one or more mitigating operations (e.g., a pricing strategy, incentives, legal constraints, etc.) may be applied to mitigate the traffic demand, as in block 618.

Figure 7:
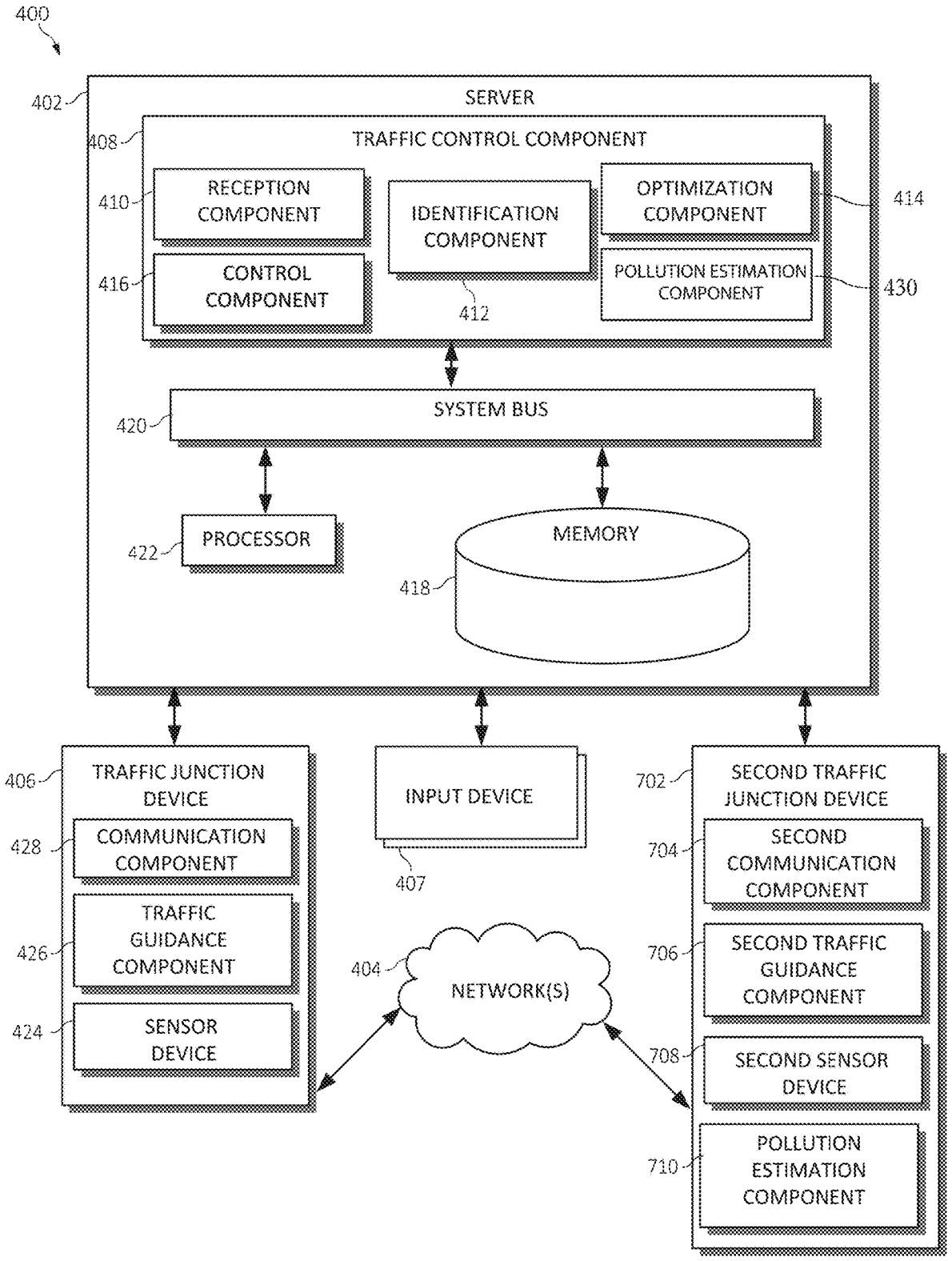
FIG. 7 illustrates a block diagram of an example, non-limiting system that identifies and optimizes phase sequences between at least two traffic junctions for controlling pollution at two traffic junctions in accordance with one or more embodiments described herein.

FIG. 7 illustrates a non-limiting example of the system 400 that comprises at least two traffic junction devices (e.g., traffic junction device 406 and second traffic junction device 702). Repetitive description of like elements employed in other embodiments described herein such as, for example, FIG. 4A is omitted for sake of brevity.

The second traffic junction device 702 can comprise: one or more second communication components 704, one or more second traffic guidance components 706, one or more second sensor devices 708 (e.g., traffic flow sensors), a pollution estimation component 710. The second traffic junction device 702, and one or more of its associate features, can function in the same manner as described above with regard to the traffic junction device 406. The server 402 can receive information from both the traffic junction device 406 and the second traffic junction device 702.

Further, the identification component 412 can generate one or more multivariate polynomials based on information collected and/or derived by both the traffic junction device 406 and the second traffic junction device 702. For example, the identification component 412 can generate a piece-wise multivariate polynomial as a concatenation of a plurality of sinusoid signals, wherein one or more sinusoid signals of the plurality of sinusoid signals are based on information collected by the traffic junction device 406 and one or more sinusoid signals of the plurality of sinusoid signals are based on information collected by the second traffic junction device 702. Also, the identification component 412, in association with pollution estimation component 710 (and/or pollution estimation component 430 of FIG. 4A) may identify, measure, and/or detect one or more pollutants and/or pollution levels.

Further, the optimization component 414 can generate control directives regarding both the traffic junction device 406 and the second traffic junction device 702, and the control component 416 can send the generated control directives to the respective traffic junction device regarded by the respective control directive. Moreover, while FIG. 7 illustrates only one second traffic junction device 702, the system 400 comprising multiple second traffic junction devices 702 is also envisaged.

Figure 8:
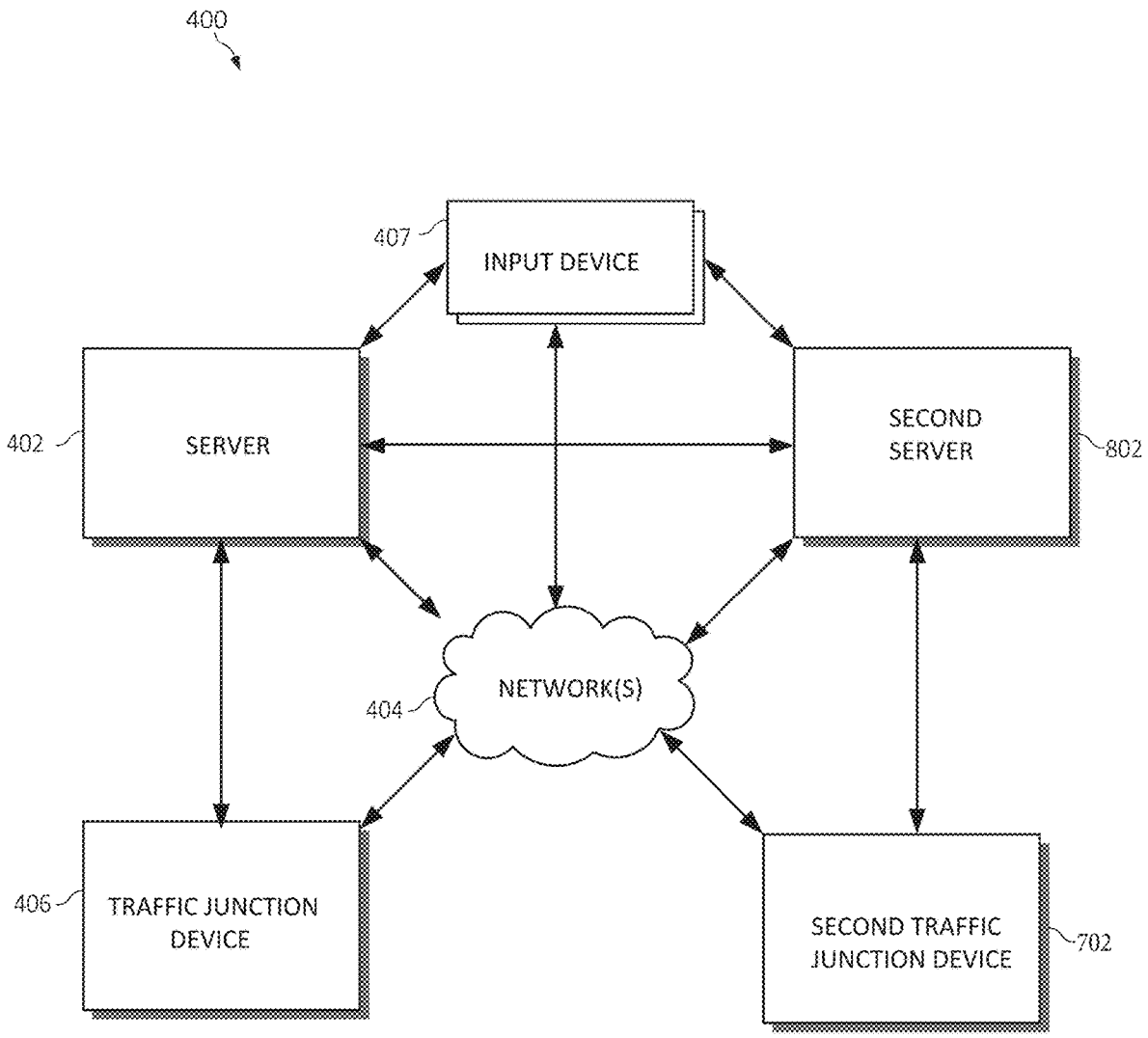
FIG. 8. illustrates a block diagram of an example, non-limiting system that identifies and optimizes phase sequences in one or more traffic junctions in accordance with one or more embodiments described herein.

FIG. 8 illustrates a non-limiting example of the system 400 that comprises multiple servers (e.g., server 402 and second server 802) in addition to multiple traffic junction devices (e.g., traffic junction device 406 and second traffic junction device 702). Repetitive description of like elements employed in other embodiments described herein is omitted for sake of brevity. The second server 802 can comprise similar components as those described above with regard to server 402 and perform similar functions as those described above with regard to server 402. Server 402 and second server 802 can be operably coupled and/or server 402 and second server 802 can communicate via one or more networks 404. In various embodiments, server 402 can be responsible for controlling real-time pollution at a traffic junction, generating multivariate polynomials, optimizing traffic flow based on optimization objectives, and generating control directives with regard to a traffic junction (e.g., traffic junction device 406); whereas the second server 802 can be responsible for controlling real-time pollution at a traffic junction, generating multivariate polynomials, optimizing traffic flow based on optimization objectives, and generating control directives with regard to another traffic junction (e.g., second traffic junction device 702).

Server 402 and second server 802 can communicate received information (e.g., data regarding the respective server's respective traffic junction) and/or derived information (e.g., pollution levels, generated multivariate polynomials, and/or generated control directives). Since the system 400 can comprise multiple servers in communication with each other (e.g., via a cloud environment), the system 400 can be de-centralized and less susceptible to a single-point-of-failure scenario. Moreover, while FIG. 8 illustrates only one second server 802, the system 400 comprising multiple second servers 802 is also envisaged.

Figure 9:
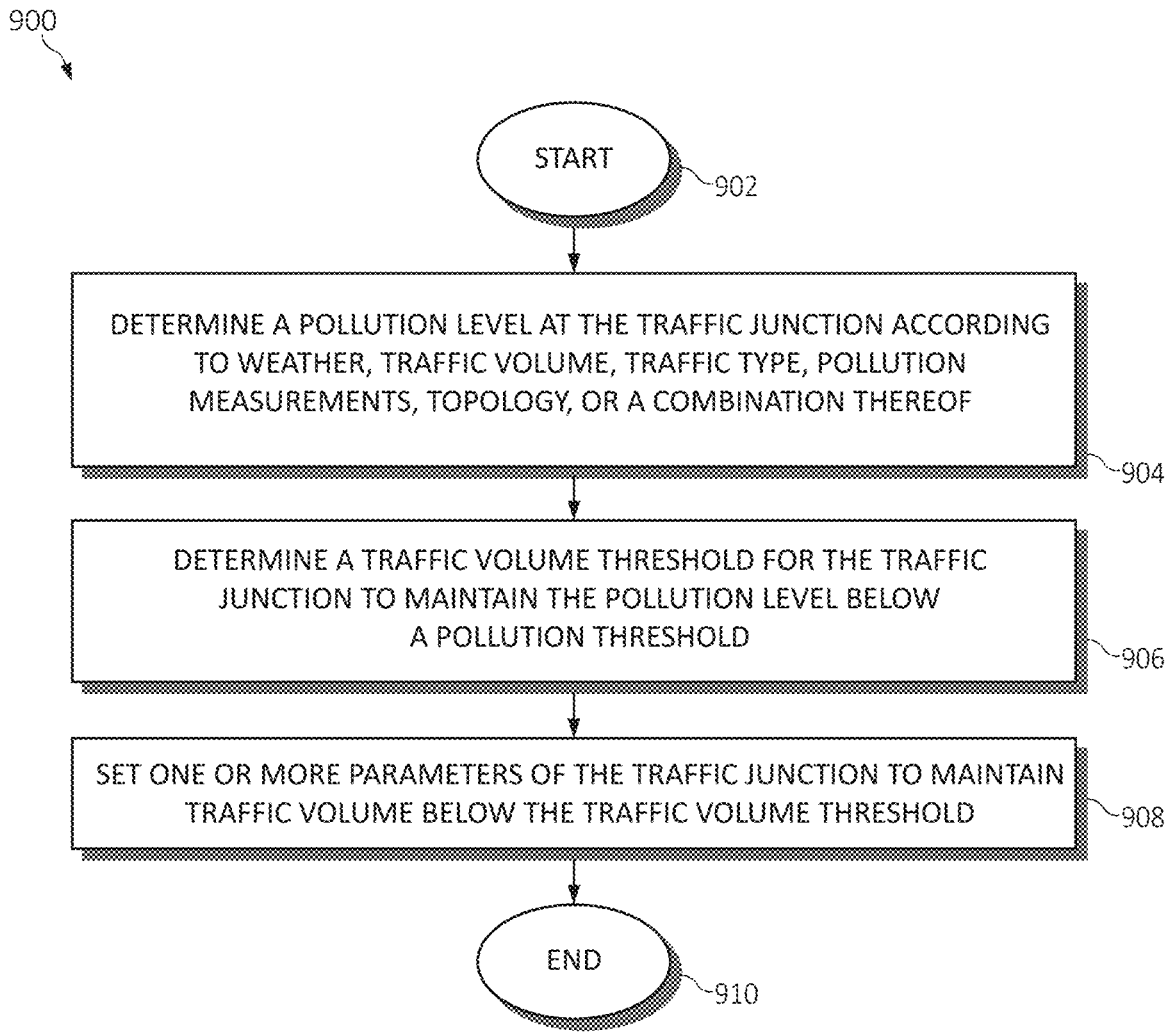
FIG. 9 is an additional flowchart diagram depicting an additional exemplary method for controlling pollution at a traffic junction by a processor, again in which aspects of the present invention may be realized.

Turning now to FIG. 9, a method 900 for real-time pollution control at a traffic junction by a processor is depicted, in which various aspects of the illustrated embodiments may be implemented. The functionality 900 may be implemented as a method executed as instructions on a machine, where the instructions are included on at least one computer readable medium or one non-transitory machine-readable storage medium. The functionality 900 may start in block 902. A pollution level may be determined at the traffic junction according to weather, traffic volume, traffic type, pollution measurements, topology, or a combination thereof, as in block 904. A traffic volume threshold may be determined for the traffic junction to maintain the pollution level below a pollution threshold, as in block 906. One or more parameters of the traffic junction may be set to maintain traffic volume below the traffic volume threshold, as in block 908. The functionality 900 may end, as in block 910.

In one aspect, in conjunction with and/or as part of at least one block of FIG. 9, the operations of method 900 may include each of the following. The operations of method 900 may monitor the pollution level and the traffic volume at the traffic junction. The pollution level, the traffic flow, and a queue length of a defined traffic type from a plurality of traffic types may be estimated at the traffic junction.

Also, the setting the one or more parameters of the traffic junction further includes setting a time of a start of each traffic signal phase sequence for the traffic junction, estimating a cycle length of each traffic signal phase, and/or setting one or more constraint violations to influence demand for use of the traffic junction. The operations of method 900 may be a pricing strategy for alternative means of transportation.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowcharts and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowcharts and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowcharts and/or block diagram block or blocks.

The flowcharts and block diagrams in the Figures illustrate the architecture, functionality, and operation of possible implementations of systems, methods, and computer program products according to various embodiments of the present invention. In this regard, each block in the flowcharts or block diagrams may represent a module, segment, or portion of instructions, which comprises one or more executable instructions for implementing the specified logical function(s). In some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts or carry out combinations of special purpose hardware and computer instructions.

The invention claimed is:

1. A method for real-time pollution control at a traffic junction by a processor, comprising:

determining a pollution level at the traffic junction according to a combination of weather, traffic volume, traffic type, pollution measurements, and topology;

determining a traffic volume threshold for the traffic junction estimated to maintain the pollution level below a pollution threshold while simultaneously being equal or less than a known capacity of the traffic junction; and setting one or more parameters of the traffic junction to maintain traffic volume below the traffic volume threshold, wherein setting the one or more parameters of the traffic junction includes setting a pricing strategy for alternative means of transportation.

2. The method of claim 1, further including monitoring the pollution level and the traffic volume at the traffic junction.

3. The method of claim 1, further including estimating the pollution level, the traffic flow, and a queue length of a defined traffic type from a plurality of traffic types at the traffic junction.

4. The method of claim 1, wherein setting the one or more parameters of the traffic junction further includes setting a time of a start of each traffic signal phase sequence for the traffic junction.

5. The method of claim 1, wherein setting the one or more parameters of the traffic junction further includes estimating a cycle length of each traffic signal phase.

6. The method of claim 1, wherein setting the one or more parameters of the traffic junction further includes setting one or more constraint violations to influence demand for use of the traffic junction.

7. A system for real-time pollution control at a traffic junction, comprising:

one or more computers with executable instructions that when executed cause the system to:

determine a pollution level at the traffic junction according to a combination of weather, traffic volume, traffic type, pollution measurements, and topology;

determine a traffic volume threshold for the traffic junction estimated to maintain the pollution level below a pollution threshold while simultaneously being equal or less than a known capacity of the traffic junction; and set one or more parameters of the traffic junction to maintain traffic volume below the traffic volume threshold, wherein setting the one or more parameters of the traffic junction includes setting a pricing strategy for alternative means of transportation.

8. The system of claim 7, wherein the executable instructions further monitor the pollution level and the traffic volume at the traffic junction.

9. The system of claim 7, wherein the executable instructions further estimate the pollution level, the traffic flow, and a queue length of a defined traffic type from a plurality of traffic types at the traffic junction.

10. The system of claim 7, wherein setting the one or more parameters of the traffic junction further includes setting a time of a start of each traffic signal phase sequence for the traffic junction.

11. The system of claim 7, wherein setting the one or more parameters of the traffic junction further includes estimating a cycle length of each traffic signal phase.

12. The system of claim 7, wherein setting the one or more parameters of the traffic junction further includes setting one or more constraint violations to influence demand for use of the traffic junction.

13. A computer program product for, by a processor, real-time pollution control at a traffic junction, the computer program product comprising a non-transitory computer-readable storage medium having computer-readable program code portions stored therein, the computer-readable program code portions comprising:

an executable portion that determines a pollution level at the traffic junction according to a combination of weather, traffic volume, traffic type, pollution measurements, and topology;

an executable portion that determines a traffic volume threshold for the traffic junction estimated to maintain the pollution level below a pollution threshold while simultaneously being equal or less than a known capacity of the traffic junction; and an executable portion that sets one or more parameters of the traffic junction to maintain traffic volume below the traffic volume threshold, wherein setting the one or more parameters of the traffic junction includes setting a pricing strategy for alternative means of transportation.

14. The computer program product of claim 13, further includes an executable portion that monitors the pollution level and the traffic volume at the traffic junction.

15. The computer program product of claim 13, wherein setting the one or more parameters of the traffic junction further includes an executable portion that estimates the pollution level, the traffic flow, and a queue length of a defined traffic type from a plurality of traffic types at the traffic junction.

16. The computer program product of claim 13, wherein setting the one or more parameters of the traffic junction further includes setting a time of a start of each traffic signal phase sequence for the traffic junction.

17. The computer program product of claim 13, wherein setting the one or more parameters of the traffic junction further includes:

estimating a cycle length of each traffic signal phase; and setting one or more constraint violations to influence demand for use of the traffic junction.

* * * * *